US008096040B2

(12) United States Patent
Wing

(10) Patent No.: US 8,096,040 B2
(45) **Date of Patent: *Jan. 17, 2012**

(54) METHOD OF ASSEMBLING A HANDLE TO A SELECTIVE ONE OF A FRONT FACE AND A SIDE EDGE OF A REFRIGERATOR DOOR

(75) Inventor: Forrest F. Wing, Des Moines, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 104 days.

This patent is subject to a terminal disclaimer.

(21) Appl. No.: 12/481,999

(22) Filed: Jun. 10, 2009

(65) Prior Publication Data

US 2009/0241323 A1 Oct. 1, 2009

Related U.S. Application Data

(62) Division of application No. 11/043,190, filed on Jan. 27, 2005, now Pat. No. 7,559,119.

(51) Int. Cl.
*B23P 11/00* (2006.01)
*E05B 1/00* (2006.01)

(52) U.S. Cl. ..... 29/525.01; 29/525.11; 29/469; 16/412; 16/436

(58) Field of Classification Search ..... 16/412, 16/413, 436, 443, 444, DIG. 40, DIG. 41; 248/254, 278.1, 256, 257, 282.1, 261; 411/52, 411/53; 49/460, 461; 312/248.6, 401, 405; 403/381; 29/525.01, 525.11, 469
See application file for complete search history.

(56) References Cited

U.S. PATENT DOCUMENTS

| | | | | | |
|---|---|---|---|---|---|
| 3,426,385 | A * | 2/1969 | Gutshall | 16/412 |
| 3,995,349 | A * | 12/1976 | Roberts et al. | 16/412 |
| 4,047,263 | A * | 9/1977 | Tietze | 16/444 |
| 4,635,889 | A * | 1/1987 | Bell et al. | 248/265 |
| 4,922,576 | A * | 5/1990 | Weidner et al. | 16/413 |
| 5,303,451 | A * | 4/1994 | Graviss et al. | 16/412 |
| 5,440,783 | A * | 8/1995 | Allardyce et al. | 16/110.1 |
| 5,562,090 | A * | 10/1996 | Katz | 126/198 |
| 5,632,062 | A * | 5/1997 | Katz et al. | 16/412 |
| 5,675,867 | A * | 10/1997 | Howie, Jr. | 16/412 |
| 5,740,587 | A * | 4/1998 | Onai et al. | 16/412 |
| 6,546,597 | B2 * | 4/2003 | Atalla et al. | 16/436 |
| 6,609,274 | B2 * | 8/2003 | Christensen et al. | 16/412 |
| 6,629,339 | B2 * | 10/2003 | Pohl et al. | 16/436 |
| 6,668,424 | B1 * | 12/2003 | Allen et al. | 16/444 |
| 7,458,133 | B2 * | 12/2008 | Wing | 16/412 |
| 7,516,531 | B2 * | 4/2009 | Crompton et al. | 29/428 |
| 7,549,713 | B2 * | 6/2009 | Gose et al. | 312/405 |
| 7,559,119 | B2 * | 7/2009 | Wing | 16/412 |
| 7,793,388 | B2 * | 9/2010 | Wing | 16/412 |

(Continued)

*Primary Examiner* — Essama Omgba
(74) *Attorney, Agent, or Firm* — Kirk W. Goodwin; Diederiks & Whitelaw PLC

(57) ABSTRACT

A method of assembling allows a refrigerator handle to be selectively mounted to a front face portion or a side edge of a refrigerator door. The handle includes first and second ends separated by an intermediate portion, wherein each of the handle ends includes a recessed section. Each of the recessed sections includes a mounting arrangement formed therein, which is adapted to receive either a bracket for mounting the handle to the side edge of the door or a clip for mounting the handle to the front face portion of the door. The method includes selectively attaching the handle to the front face of the door through the clip, or to the side edge with the mounting bracket.

8 Claims, 6 Drawing Sheets

U.S. PATENT DOCUMENTS

| | | | | |
|---|---|---|---|---|
| 7,849,563 | B2 * | 12/2010 | Wing | 16/412 |
| 2003/0093876 | A1 * | 5/2003 | Jung et al. | 16/110.1 |
| 2004/0010888 | A1 * | 1/2004 | Wing et al. | 16/436 |
| 2004/0181911 | A1 * | 9/2004 | Tisol et al. | 16/412 |
| 2006/0085948 | A1 * | 4/2006 | Brammer et al. | 16/412 |
| 2006/0143865 | A1 * | 7/2006 | Magyar et al. | 16/412 |

* cited by examiner

METHOD OF ASSEMBLING A HANDLE TO A SELECTIVE ONE OF A FRONT FACE AND A SIDE EDGE OF A REFRIGERATOR DOOR

CROSS-REFERENCE TO RELATED APPLICATION

This application is a divisional of U.S. application Ser. No. 11/043,190, filed Jan. 27, 2005, now U.S. Pat. No. 7,559,119 which is hereby incorporated by reference.

BACKGROUND OF THE INVENTION

1. Field of the Invention

The present invention pertains to the art of refrigerators and, more particularly, to a mounting arrangement for a handle of a refrigerator.

2. Discussion of the Prior Art

Conventional handle arrangements for refrigerators are formed from multiple pieces, including a handle frame and a handle piece having a gripping portion. Such a handle is typically mounted to a refrigerator cabinet utilizing screws which extend through the handle piece and frame, clamping the overall handle to a panel of the refrigerator cabinet. Once the handle is in place, a cover is inserted over the screw, with the cover extending only over the area of the screws or along substantially the entire length of the handle. In general, this known handle mounting arrangement is rather labor intensive to assemble and often results in witness lines that take away from the overall aesthetics of the refrigerator.

In certain situations, it is desirable to mount a refrigerator handle to a side edge of a refrigerator door, such as the handle described in U.S. Pat. No. 6,546,597. The handle in the '597 patent has metal inserts integrally molded into handle ends to reinforce the handle. The handle ends include a first portion that abuts a front surface of the door and a second portion that abuts the side edge of the door. Mechanical fasteners extend through the second portion for attaching the handle to the door. Since the handle is molded with metal inserts that essentially wrap around the side edge of the door, the use of the handle is limited to a side mounting arrangement.

Regardless of the existence of various types of refrigerator handle arrangements and mounting systems therefor, there still exists a need in the art for a universal refrigerator handle that is capable of being mounted to either the front surface or side edge of a refrigerator door. Such a universal handle would provide significant cost savings because a single process would be used to make the handle. Additional parts necessary to mount the handle to the front surface or side edge of the refrigerator door can be easily fastened to the handle during assembly of the refrigerator.

SUMMARY OF THE INVENTION

The present invention pertains to a universal handle for mounting to a door of a refrigerator. In accordance with the most preferred form of the invention, the universal handle may be selectively mounted to a front face portion or a side edge of a refrigerator door. The universal handle includes first and second handle ends separated by an intermediate portion, wherein each of the first and second handle ends include recessed sections. Each of the recessed sections includes a mounting arrangement formed therein, which is adapted to receive either a bracket member for mounting the handle to the side edge of the door or a clip for mounting the handle to the front face portion of the door.

When mounting the handle to the side edge of the door, a pair of brackets, each of which is formed of metal and includes a first portion and a second portion, are attached to the handle by fastening the first portion of one bracket to the mounting arrangement within a respective handle end. The second end of each bracket member is fastened to a respective metal plate attached to the side edge of the door. Since this arrangement allows for metal-to-metal attachment of the handle, the handle is securely fastened to the door and the attachment will not loosen over time.

When mounting the handle to the front panel of the door, first and second handle clip members are attached to the mounting arrangement of each handle end. The front panel of the door includes base members mounted thereon for engaging the handle clip members. With this arrangement, the handle can be removably attached to the front panel of the door.

Additional objects, features and advantages of the present invention will be more readily apparent from the following detailed description when taken in conjunction with the drawings wherein like reference numerals refer to corresponding parts in the several views.

DETAILED DESCRIPTION OF THE PREFERRED EMBODIMENTS

Figure 1:
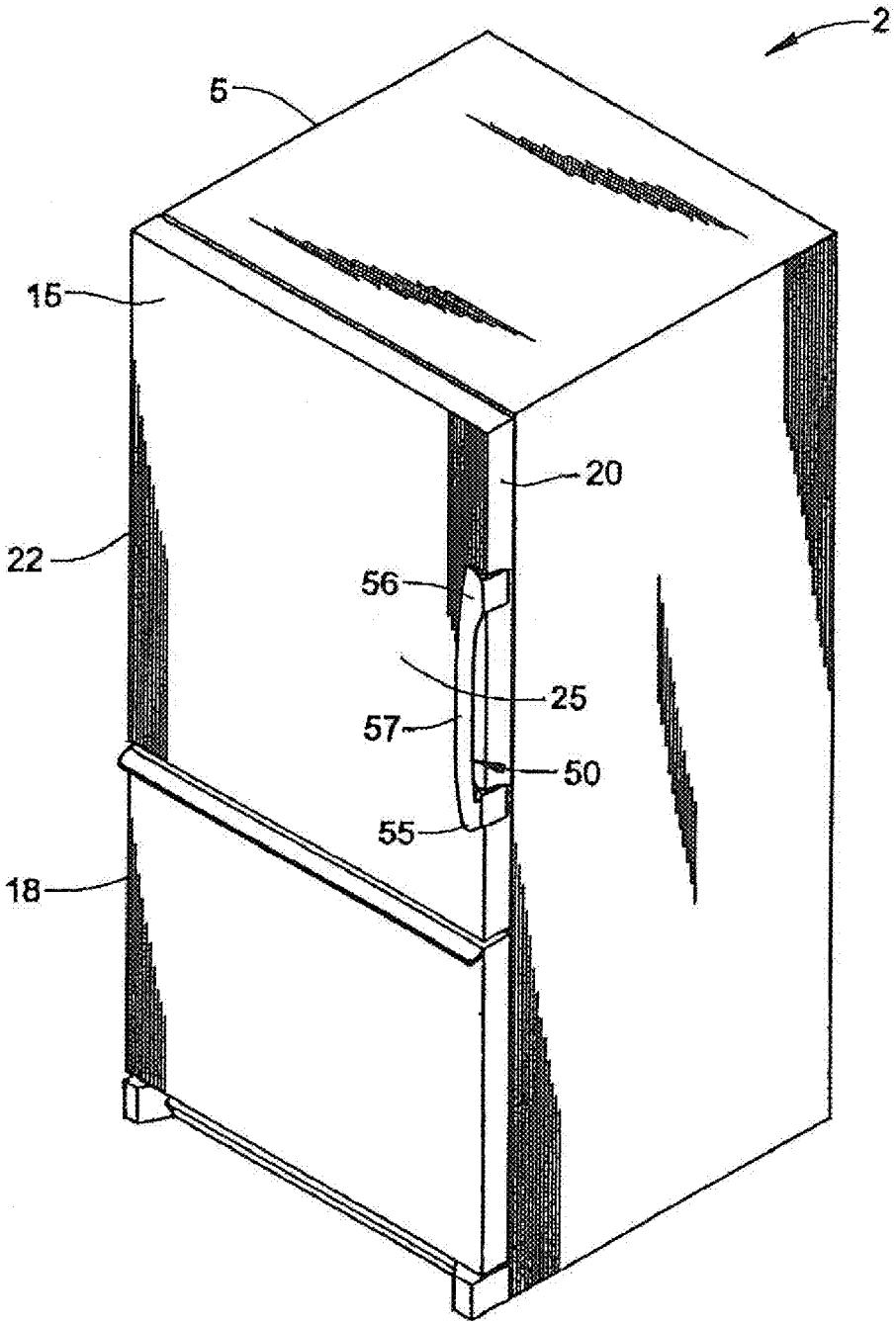
FIG. 1 is an upper right front perspective view of a refrigerator cabinet incorporating a refrigerator door handle constructed in accordance the present invention shown in a side mount arrangement.

With initial reference to FIG. 1, a refrigerator incorporating the present invention is generally indicated at 2. Although the invention can be applied to various different types and styles of refrigerators, as shown, refrigerator cabinet 2 includes a cabinet shell 5 provided with an upper fresh food compartment door 15 and a lower freezer compartment door 18. With this general construction, refrigerator 2 defines a bottom mount style unit. Aside from the aspects which will be described more fully below, the basic construction and operation of refrigerator 2 is known in the art, does not form part of the present invention, and therefore will not be discussed further herein.

Fresh food door 15 includes side edges 20 and 22 and a front surface 25. Side edge 22 is pivotally attached to cabinet shell 5 through upper and lower hinges (not shown). Freezer door 18 is adapted to slide relative to cabinet shell 5 between open and closed positions. As known in the art, fresh food and freezer doors 15 and 18 conceal fresh food and freezer compartments (not shown) of refrigerator cabinet 2. Again, the exact construction of refrigerator 2 can vary greatly without departing from the invention.

Figure 2:
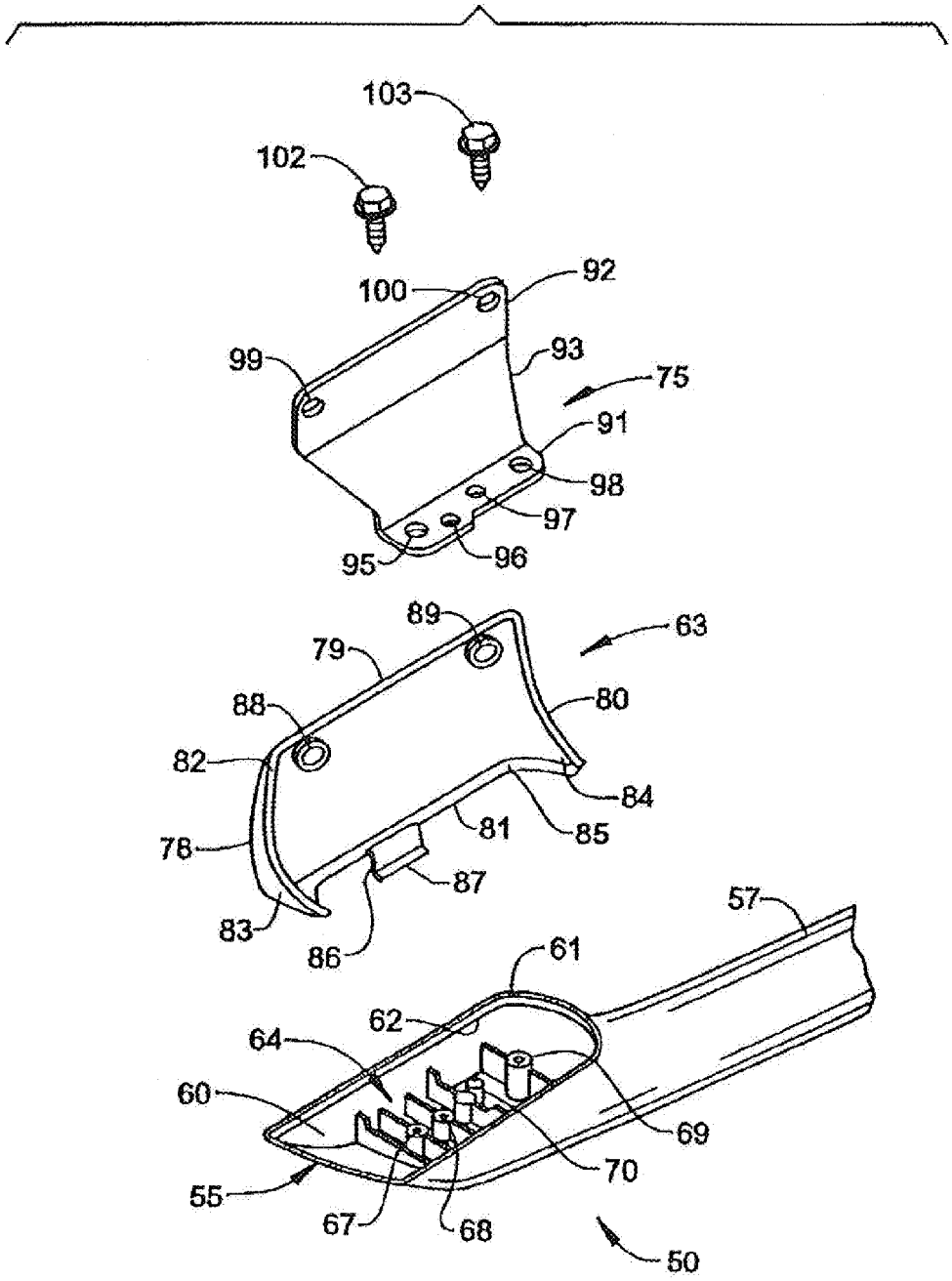
FIG. 2 is an exploded view of an end of the handle of FIG. 1.
Figure 3:
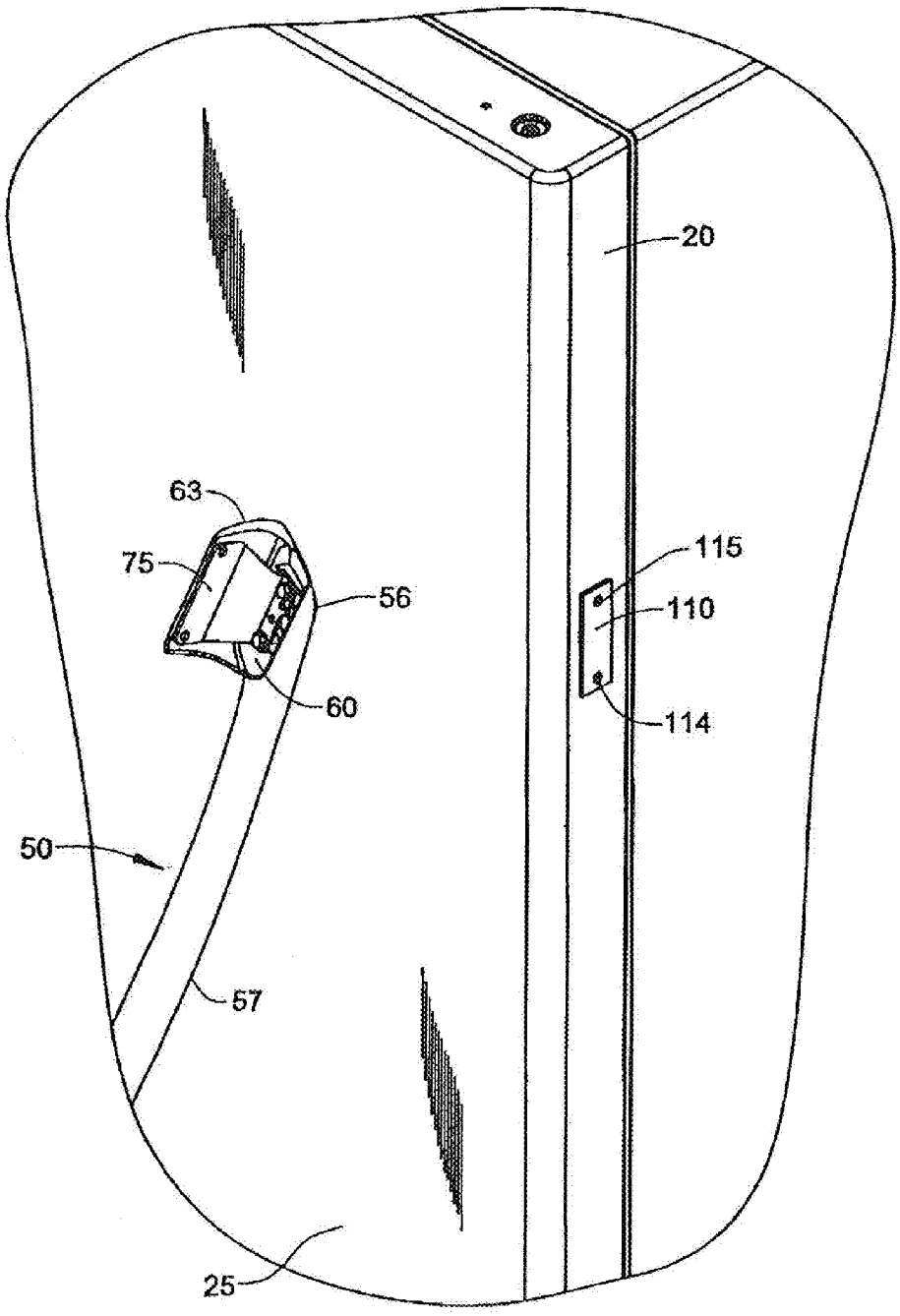
FIG. 3 is a partial exploded view depicting a backside of the refrigerator handle of FIGS. 1 and 2.

The present invention is actually directed to a universal handle 50 that may be selectively mounted to either front surface 25 or edge 20 of fresh food door 15. As shown, handle 50 includes a pair of handle ends 55 and 56 and an intermediate portion 57 interconnecting handle ends 55 and 56. At this point it should be realized that, although reference will be made to handle end 55, handle end 56 includes identical components. As best shown in FIGS. 2 and 3, the underside of handle end 55 is formed with a recessed section 60 having an outer periphery 61 and a ledge 62 stepped below and projecting slightly inward from outer periphery 61. Ledge 62 assists in the attachment of a cover member 63 to handle end 55, as will be described in detail below. Recessed section 60 also has a mounting arrangement 64 formed therein. Each mounting arrangement 64 includes a locating projection 70 and bores 67, 68 and 69 formed therein. Each of bores 67-69 is formed within a webbed or ribbed configuration (not separately labeled) for providing added strength to mounting arrangement 64.

Reference will now be particularly made to FIG. 2 in describing the mounting of handle 50 to side edge 20 of fresh food door 15. A bracket 75, which is preferably formed of steel, is used to fasten handle end 55 to side edge 20. Preferably, cover member 63 is attached to end 55 for concealing bracket 75. Cover member 63 includes edges 78-81. A lip 82 extends outward from edges 78-80 for abutting side edge 20 of fresh food door 15. Lip 82 projects into rounded corner extensions 83 and 84 where edges 78 and 80 meet edge 81. Extending from edge 81 and rounded corner extensions 83 and 84 is a positioning rim 85 that abuts ledge 62 of recessed section 60 when cover 63 is in position as shown in FIG. 3 with reference to handle end 56. A tab 86 projects from positioning rim 85. Tab 86 includes a terminal strip 87 which is engaged by bracket 75 for holding cover 63 in place after bracket 75 is attached. Each cover member 74 also includes holes 88 and 89 formed adjacent edge 79.

Each bracket 75 includes a first portion 91, a second portion 92 extending substantially perpendicular to first portion 91, and an angled middle portion 93 interconnection first and second portions 91 and 92. First portion 91 of bracket 75 includes spaced apart apertures 95-98 for cooperating with mounting arrangement 64 and second portion 92 includes spaced apart apertures 99 and 100 for cooperating with a pair of mechanical fasteners, as will be discussed in detail below.

Prior to attaching handle 50 to side edge 20, bracket 75 and cover member 63 must be attached to handle end 55. Initially, cover 63 is positioned within recessed section 60 such that positioning rim 85 of cover member 63 rests against ledge 62 of recessed section 60 and tab 86 projects downward into recessed section 60. First portion 91 of bracket 75 is positioned within recessed section 60 such that locating projection 70 extends through aperture 97 and apertures 95 and 98 align with bores 67 and 69, respectively. Mechanical fasteners, such as screws 102 and 103, extend through the respective apertures 95 and 98 and bores 67 and 69 to fasten bracket 75 to mounting arrangement 64, as illustrated in FIGS. 2 and 3. When bracket 75 is attached to mounting arrangement 64, bracket 75 abuts terminal strip 87 of tab 86 to hold cover 63 in place. Holes 88 and 89 on cover 63 are aligned with apertures 99 and 100 of bracket 75. The assembled arrangement is shown in FIG. 3 with reference to handle end 56.

Each of a pair of steel plates, one of which is indicated at 110 in FIG. 3, includes holes 114 and 115, is affixed to side edge 20 of door 15 to provide a reinforced metal contact surface for attaching handle 50. When attaching handle 50 to door 15, holes 88 and 89 on cover member 74, apertures 99 and 100 of bracket 75, and holes 114 and 115 are all aligned, and screws (not shown) are used to secure handle 50 to side edge 20 of door 15 as clearly shown in FIG. 1. Second portion 92 of bracket 75 directly contacts plate 110 when handle 50 is mounted in this manner. Therefore, due to this metal to metal attachment, handle 50 will not loosen over time.

Figure 4:
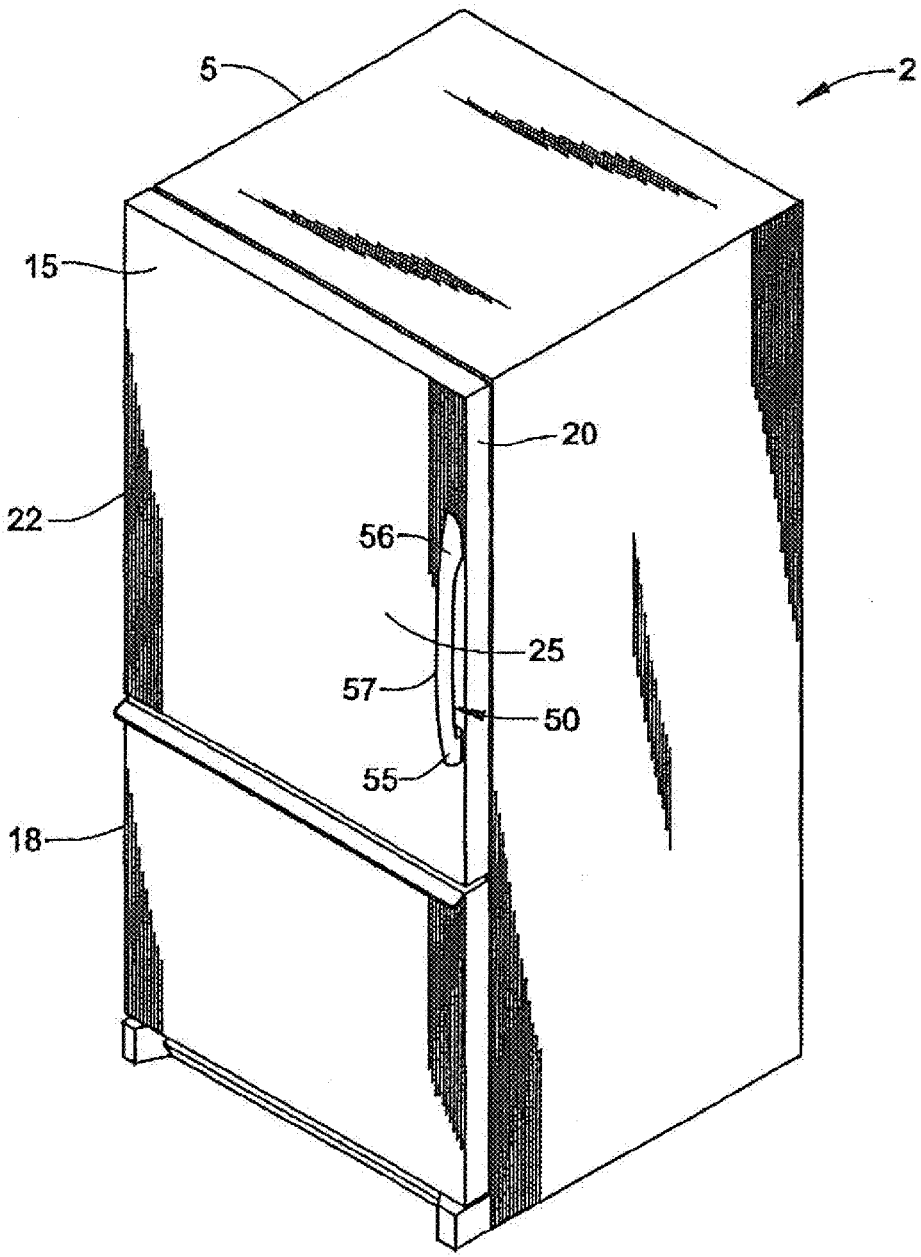
FIG. 4 is an upper right front perspective view of a refrigerator cabinet incorporating a refrigerator door handle constructed in accordance the present invention shown in a front mount arrangement.
Figure 5:
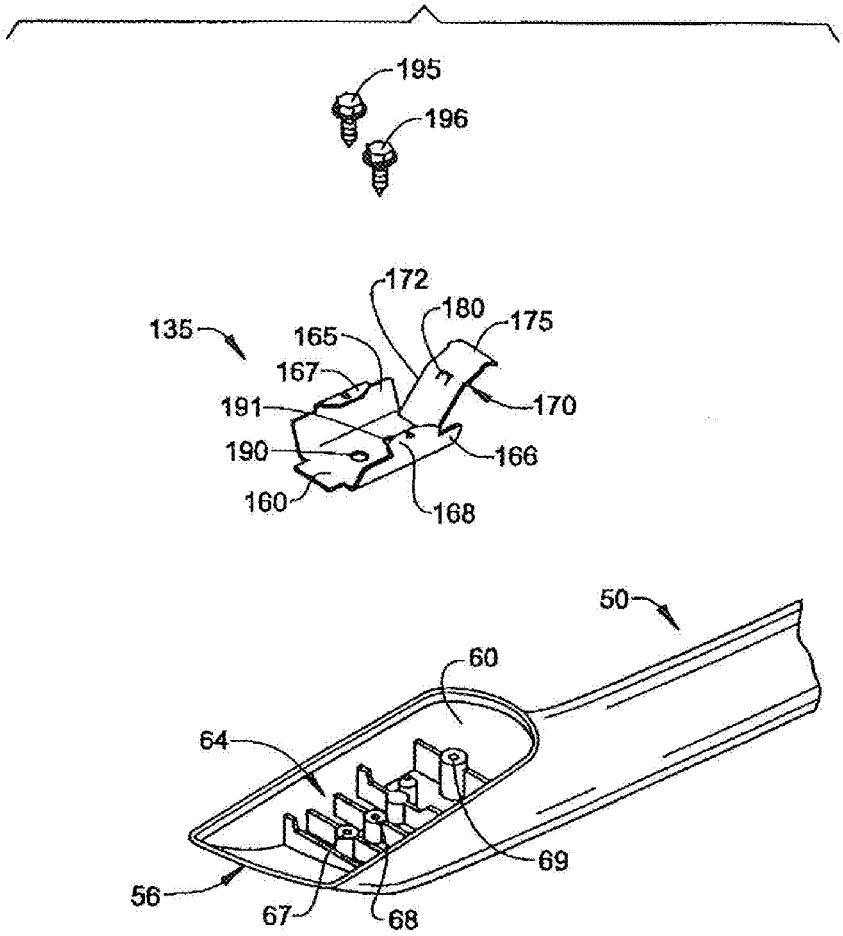
FIG. 5 is an exploded view of an end of the handle of FIG. 4.
Figure 6:
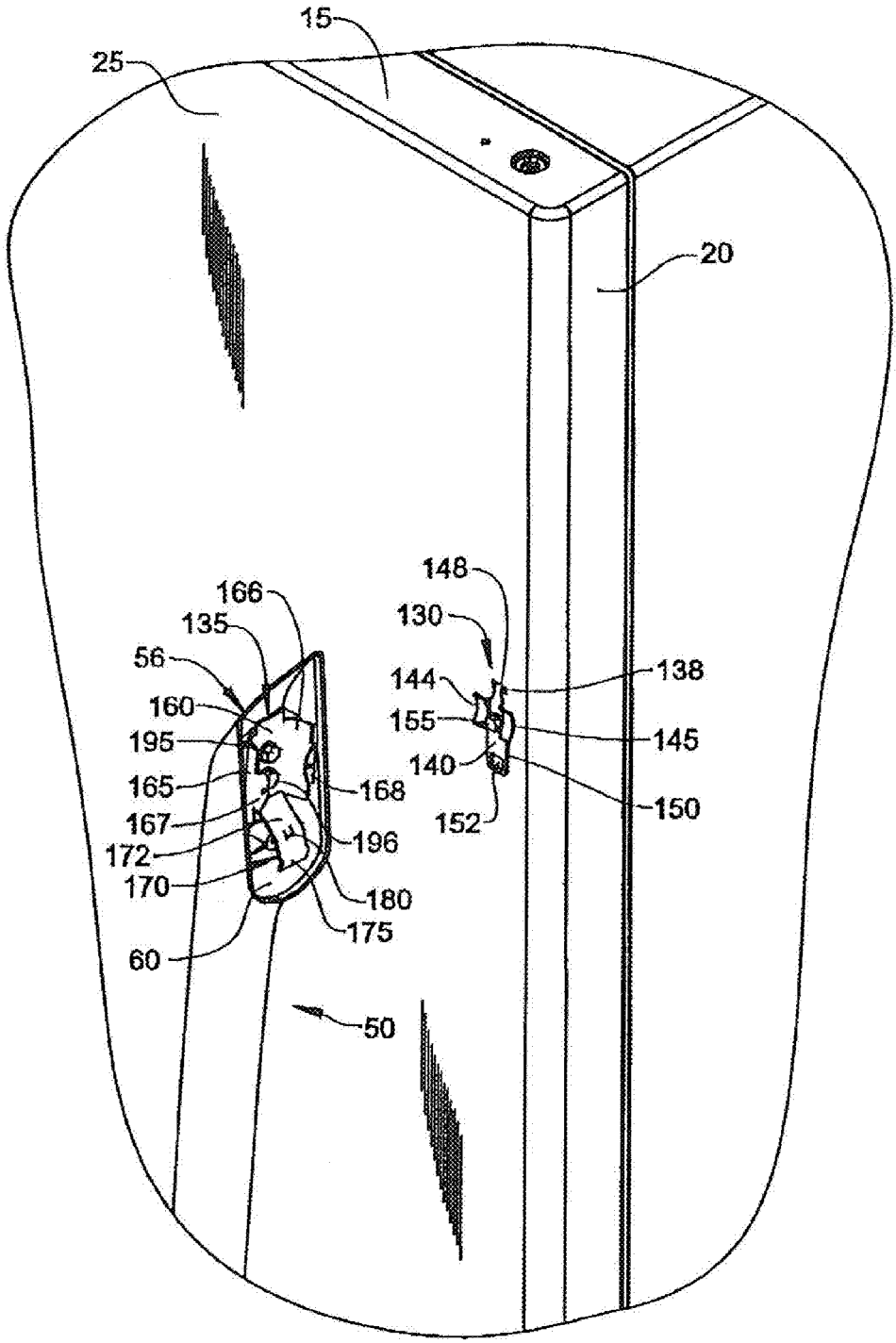
FIG. 6 is a partial exploded view depicting a backside of the refrigerator handle of FIGS. 4 and 5.

With reference to FIGS. 4-6, the front mounting arrangement of handle 50 will be described. Since handle 50 is the same as described in the side mounting arrangement, the details of handle 50 will not be reiterated. The mounting of handle 50 will be described with reference to handle end 56 of handle 50 and it should be realized that handle end 55 is mounted in a corresponding manner. Initially, a base or door clip member 130 (FIG. 6) is mounted to front surface 25 of fresh food door 15, while a handle clip member 135 (FIGS. 5 and 6) is initially fastened to mounting arrangement 64. More specifically, fresh food door 15 is provided with a hole (not shown) and a slot 138 positioned above the hole. In accordance with the most preferred form of the invention, each door clip member 130 includes a main base section 140 which defines a pair of spaced side connectors 144 and 145. As depicted, each side connector 144, 145 is generally concave in shape, while defining an arcuate or convexly curved lower surface (not separately labeled). Projecting from one end of main base section 140 is a tab member 148. Projecting from another end of main base section 140 is a leg extension 150 provided with a through hole 152, which is shown to be generally rectangular or square in shape. Main base section 140 is also provided with a substantially central aperture (not shown).

Each door clip member 130 is initially mounted to surface 25 of fresh food door 15 with tab member 148 projecting into a respective slot 138 and the central aperture of door clip member 130 being aligned with the hole provided in fresh food door 15. Thereafter, a mechanical fastener 155, such as a sheet metal screw 155, extends through the aperture of door clip member 130 and is threadably attached to fresh food door 15 at the hole to fixedly secure door clip member 130 along surface 25. At this point, it should be realized that the structure and mounting method of door clip member 130 can be readily varied without departing from the invention. Further details of door clip member 130 are described in co-pending U.S. patent application Ser. No. 10/295,850 herein incorporated by reference.

As best shown in FIGS. 5 and 6, each handle clip member 135 includes a base portion 160, upstanding side wall portions 165 and 166, in-turned flange members 167 and 168 stemming from side wall portions 164 and 165 respectively, and a cantilevered arm 170. As shown, arm 170 includes a first angled section 172, preferably extending at an angle of approximately 36° from base portion 160, leading to a catch section 175. First angled section 172 preferably projects from base portion 160 a distance slightly greater the height of side wall portions 165 and 166. In this manner, catch section 175 extends substantially parallel to flange members 167 and 168, while being spaced from base portion 160 a distance greater than flange members 167 and 168. First angled section 172 is actually lanced and bent such that a clip member 180 is defined adjacent catch section 175. In addition, base portion 160 is provided with a pair of spaced holes 190 and 191.

In accordance with the most preferred form of the invention, each handle clip member 135 is received in a respective recessed section 60 as clearly shown in FIGS. 5 and 6. When in this position, spaced holes 190 and 191 are aligned with bores 67 and 68, while mechanical fasteners 195 and 196 are used to secure each handle clip member 135 within a respective recessed section 60.

With this arrangement, following the mounting of door clip members 130 to fresh food door 15 in the manner set forth above, first and second end portions 55 and 56 of handle 50 can be completely laid over the respective door clip members 130, with each door clip member 130 being initially arranged adjacent a respective handle clip member 135 within a recessed section 60. Thereafter, the entire handle 50 is shifted or slid relative to door clip members 130 and door 15. Due to the shape of side connectors 144 and 155, the shifting of handle 50 causes side connectors 144 and 155 to engage flange members 167 and 168. Therefore, as handle 50 is shifted in this manner, a wedging action results that causes handle 50 to be drawn against door 15. That is, door clip members 130 and handle clip members 135 include mating surfaces which co-act to draw handle 50 to the front face portion of door 15. With the shifting of handle 50, leg extension 150 will engage arm 170 to initially deflect arm 170. Thereafter, arm 170 will snap back as each clip member 180 projects into a respective hole 152. Once this snap connection is established, essentially simultaneously at both first and second end portions 55 and 56, handle 50 is fixed in position along door 15.

Based on the above, it should be readily apparent that handle 50 can be readily and selectively employed for mounting on either side edge 20 or front surface 25. When mounting on side edge 20, an advantageous reinforcement is employed and mounting brackets 75 interact with cover 63 to provide a smooth, aesthetically appealing arrangement. The manner in which handle 50 is drawn to front surface 25 in accordance with the second mounting arrangement also provides an enhanced overall mounting system. In any case, although described with reference to preferred embodiments of the invention, it should be understood that various changes and/or modifications can be made without departing from the spirit of the invention. For instance, although described with reference to a bottom mount refrigerator, a corresponding handle arrangement could be equally employed in top mount, side-by-side or other style refrigerators as well. In any event, the invention is only intended to be limited in accordance with scope of the following claims.

I claim:

1. A method of assembling a handle to a selective one of a front face and a side edge of a refrigerator door comprising:

selecting a first attachment member, with the first attachment member to be of a first type when the handle is to be mounted to the front face of the door and of a second type when the handle to be attached to the side edge of the door;

selecting a second attachment member, with the second attachment member to be of a first type when the handle is to be mounted to the front face of the door and of a second type when the handle to be attached to the side edge of the door;

fastening the first attachment member to a mounting arrangement formed within a recessed portion of a first end portion of the handle;

fastening the second attachment member to a mounting arrangement formed within a recessed portion of a second end portion of the handle; and attaching the handle to the front face of the door through the first and second attachment members if the first and second attachment members are of the first type or to the side edge of the door through the first and second attachment members if the first and second attachment members are of the second type.

2. The method of claim 1, wherein each of the first and second attachment members is of the first type and is constituted by a clip such that the handle is clipped to the front face of the door.

3. The method of claim 2, further comprising:

attaching first and second base members to the front face of the refrigerator door, said first and second attachment members being clipped to the first and second base members.

4. The method of claim 1, wherein each of the first and second attachment members is of the second type and is constituted by a bracket such that the handle is attached to the side edge of the door through the brackets.

5. The method of claim 4, wherein each bracket has a first portion and a second portion extending at an angle to the first portion, with the first portion being attached to the mounting arrangement of a respective one of said first and second end portions of the handle and the second portion being attached to the side edge of the door.

6. The method of claim 5, further comprising: attaching a cover member to the handle for concealing the second end portion of the bracket.

7. The method of claim 6, further comprising: sandwiching a tab member of the cover member between the first end portion of the handle and the bracket to attach the cover member.

8. The method of claim 5, further comprising: fixedly securing a pair of plate members at spaced locations along a portion of the side edge of the door, said second portion of each bracket being attached to the side edge of the door through a respective plate member.

* * * * *